US009568154B2

(12) United States Patent
Hansen

(10) Patent No.: US 9,568,154 B2
(45) Date of Patent: Feb. 14, 2017

(54) APPARATUS, METHOD AND SYSTEM FOR A MODULAR LIGHT-EMITTING DIODE CIRCUIT ASSEMBLY

(71) Applicant: LED Lenser Corp. Ltd., Guangdong Province (CN)

(72) Inventor: Sven Hansen, Guangdong Province (CN)

(73) Assignee: Zweibruder Optoelectronics GmbH & Co. KG, Solingen (DE)

( * ) Notice: Subject to any disclaimer, the term of this patent is extended or adjusted under 35 U.S.C. 154(b) by 231 days.

(21) Appl. No.: 14/056,419

(22) Filed: Oct. 17, 2013

(65) Prior Publication Data

US 2014/0126229 A1 May 8, 2014

(30) Foreign Application Priority Data

Nov. 2, 2012 (CN) ..... 2012 1 0434741

(51) Int. Cl.
*F21K 99/00* (2016.01)
*F21V 19/00* (2006.01)
(Continued)

(52) U.S. Cl.
CPC . *F21K 9/30* (2013.01); *F21K 9/20* (2016.08); *F21V 19/0015* (2013.01);
(Continued)

(58) Field of Classification Search
CPC ..... F21K 9/30; F21L 4/06
See application file for complete search history.

(56) References Cited

U.S. PATENT DOCUMENTS 1,504,980 A * 8/1924 Schultz ..... F21L 4/06 340/321
6,919,504 B2 * 7/2005 McCutcheon ..... F28D 15/0241 174/16.3
(Continued)

FOREIGN PATENT DOCUMENTS

EP 1 577 613 A2 9/2005
EP 2 083 214 A1 7/2009
(Continued)

OTHER PUBLICATIONS

Office Action from Japanese Patent Application No. 2013-228426, dated Sep. 29, 2014.
(Continued)

*Primary Examiner* — Douglas W Owens
*Assistant Examiner* — Jonathan Cooper
(74) *Attorney, Agent, or Firm* — Alston & Bird LLP

(57) ABSTRACT

Provided herein is an improved apparatus, method and system for providing a modular LED circuit assembly. Specifically, examples of the present invention include a modular LED circuit which may be scaled and used in a wide variety of form factors. One example of the present invention may provide an apparatus for supporting a light-emitting diode which includes an LED circuit board including a first major surface and a second major surface. The first major surface may include a first contact pad and a second contact pad, where each of the first contact pad and the second contact pad are configured to receive a respective connector from the LED. The second major surface of the LED circuit board may include a first area, a second area, and a third area, where a substrate is attached to the LED circuit board across the third area.

17 Claims, 19 Drawing Sheets

(51) Int. Cl.
*F21V 23/00* (2015.01)
*F21Y 101/00* (2016.01)

(52) U.S. Cl.
CPC ..... *F21V 19/0045* (2013.01); *F21V 23/005* (2013.01); *F21Y 2101/00* (2013.01)

(56) References Cited

U.S. PATENT DOCUMENTS

2004/0257552 A1* 12/2004 Hansen ..... G02B 21/24 355/55
2006/0002125 A1 1/2006 Kim et al.
2006/0146526 A1 7/2006 Shiau
2007/0008532 A1* 1/2007 Hansen ..... G01B 11/272 356/401
2007/0080362 A1* 4/2007 Scotch ..... H01L 33/641 257/99
2009/0026483 A1 1/2009 Lin
2009/0040758 A1 2/2009 Tu et al.
2009/0244909 A1 10/2009 Chen
2010/0085751 A1* 4/2010 Shaner ..... F21K 9/00 362/249.02
2010/0279544 A1* 11/2010 Dodd ..... F41C 23/22 439/533
2011/0052911 A1* 3/2011 Hansen ..... C09J 7/0275 428/339
2011/0193484 A1 8/2011 Harbers et al.
2011/0254554 A1* 10/2011 Harbers ..... H05B 33/0893 324/414
2011/0261557 A1* 10/2011 Gibson ..... F21L 4/027 362/157

FOREIGN PATENT DOCUMENTS

FR 2 887 034 A1 12/2006
JP H0521848 A 1/1993
JP 2003-068111 A 3/2003
JP 2009-021144 A 1/2009
JP 2012-142167 A 7/2012
WO WO-2011/124974 A1 10/2011
WO 2011139548 * 11/2011 ..... H05B 33/0893
WO WO 2011/139548 A2 11/2011
WO WO 2012/117310 A1 9/2012

OTHER PUBLICATIONS

Patent Examination Report from corresponding Australian Application No. 2013245459, dated Jul. 17, 2014.
Patent Examination Report No. 2 for Australian Application No. 2013245459 dated Dec. 9, 2014.
Partial European Search Report for Corresponding Application No. EP 13005192.3 dated May 2, 2016, 6 pages.
Extended European Search Report for Corresponding European Application No. 13005192.3 dated Oct. 31, 2016, 15 pages.

* cited by examiner

APPARATUS, METHOD AND SYSTEM FOR A MODULAR LIGHT-EMITTING DIODE CIRCUIT ASSEMBLY

CROSS-REFERENCE TO RELATED APPLICATIONS

This application claims priority to and the benefit of Chinese Patent Application No. 201210434741.1, filed in the Chinese Patent Office on Nov. 2, 2012, the entire contents of which are incorporated herein by reference.

FIELD OF THE INVENTION

Embodiments of the present invention generally relate to systems and methods for providing illumination and, more particularly, to an apparatus, method and system for a modular light-emitting diode circuit assembly that better dissipates heat, is less expensive to manufacture, and improves the ease of manufacture.

BACKGROUND OF THE INVENTION

Electric light sources exist in a variety of form factors from residential or commercial light fixtures to hand-held flashlights. Conventional incandescent light bulbs have given way to more efficient fluorescent light bulbs and compact florescent light (CFL) bulbs to provide substantially similar light while consuming less power. While a florescent light is more efficient than an equivalently bright incandescent light, light-emitting diodes (LEDs) are more efficient still at producing an equivalent light.

LEDs were initially relatively expensive as compared to incandescent or florescent lights, and were not suitable for many applications. Additionally, low intensity and limited color options for LEDs limited their usefulness. Recent developments in the field of LEDs have caused LED light sources to become ubiquitous replacements or supplements to conventional light sources. Further, LEDs may be packaged in considerably smaller form factors than equivalently bright incandescent lights or florescent lights. However, LEDs may be susceptible to overheating, leading to premature failure.

SUMMARY OF THE INVENTION

In light of the foregoing background, exemplary embodiments of the present invention provide an improved apparatus, method and system for providing a modular LED circuit assembly. Specifically, exemplary embodiments of the present invention include a modular LED circuit which may be scaled and used in a wide variety of form factors. One embodiment of the present invention may provide an apparatus for supporting a light-emitting diode which includes an LED circuit board including a first major surface and a second major surface. The first major surface may include a first contact pad and a second contact pad, where each of the first contact pad and the second contact pad are configured to receive a respective connector from the LED. The second major surface of the LED circuit board may include a first area, a second area, and a third area, where a substrate is attached to the LED circuit board across the third area. The first area of the second major surface of the LED circuit board may be configured to engage a first pin of an LED driving circuit and the second area of the second major surface of the LED circuit board may be configured to engage a second pin of the LED driving circuit. The substrate may include a material with a thermal conductivity greater than about 30 watts per meter-degree Kelvin (30 W/(m*k)). The substrate may be adhered to the LED circuit board with an adhesive including a thermal conductivity greater than about 30 watts per meter-degree Kelvin (30 W/(m*k)).

The first contact pad of the LED circuit may be in electrical contact with the first area of the second major surface and the second contact pad may be in electrical contact with the second area. The first contact pad and the second contact pad may not be in electrical contact with one another. The first pin of the LED driving circuit may include a first contact surface having a first contact surface area, and the second pin of the LED driving circuit may include a second contact surface having a second contact surface area. The first pin may engage the first area across the first contact surface area and the second pin may engage the second area across the second contact surface area. The first area of the LED circuit board may be greater than the first contact surface area and the second area of the LED circuit board may be greater than the second contact surface area. An air channel may be defined between the substrate and the LED driving circuit.

Embodiments of the present invention may provide an apparatus for aligning an LED. The alignment apparatus may include a first element with a first side and a second side, where the second side of the first element may be configured to receive an LED circuit board with an LED thereon. The first element may define an aperture there through, where the aperture may be configured to receive the LED. A second element including a first side and second side may be attached to the first element by a first attachment portion. The second element may define an aperture there through configured to receive the LED circuit board. The aperture of the first element may be configured to align the LED circuit board with the LED thereon. The aperture may be sized and shaped according to the LED to be received there through. The first element, the second element, and the first attachment portion may be formed of a single, unitary piece. The first element may include a material that is substantially non-conductive.

Embodiments of the present invention may provide for an apparatus for supporting an LED. The apparatus may include an LED circuit board including a first major surface and a second major surface, where the first major surface includes a first contact pad and a second contact pad, each of the first contact pad and the second contact pad being configured to receive a respective connector from the LED. The second major surface may include a first area, a second area, and a third area. The apparatus may further include an alignment member defining an alignment aperture, where the alignment member is configured to receive the LED circuit board and align the LED. The apparatus may still further include an LED driving circuit that includes a first pin and a second pin, where the first pin may be configured to electrically contact the first area of the second major surface and the second pin may be configured to electrically contact the second area of the second major surface. The first pin and the second pin of the LED driving circuit may each include a barrel and a shaft, where the shaft may be biased in an extended position within the barrel.

The first pin may include a first contact surface having a first contact surface area and the second pin may include a second contact surface having a second contact surface area, where electrical contact between the first pin and the first area may be established across the first contact surface area, and where electrical contact between the second pin and the second area may be established across the second contact surface area. The size of the first area may be greater than the size of the first contact surface area and the size of the second area may be greater than the size of the second surface contact area. The first pin and the second pin ma cooperate with the first area and the second area of the second major surface, respectively, to maintain electrical contact between the first area and the first pin and the second area and the second pin during relative motion between the LED circuit board and the LED driving circuit in any of three mutually orthogonal axes of movement.

BRIEF DESCRIPTION OF THE DRAWINGS

Figure 1:
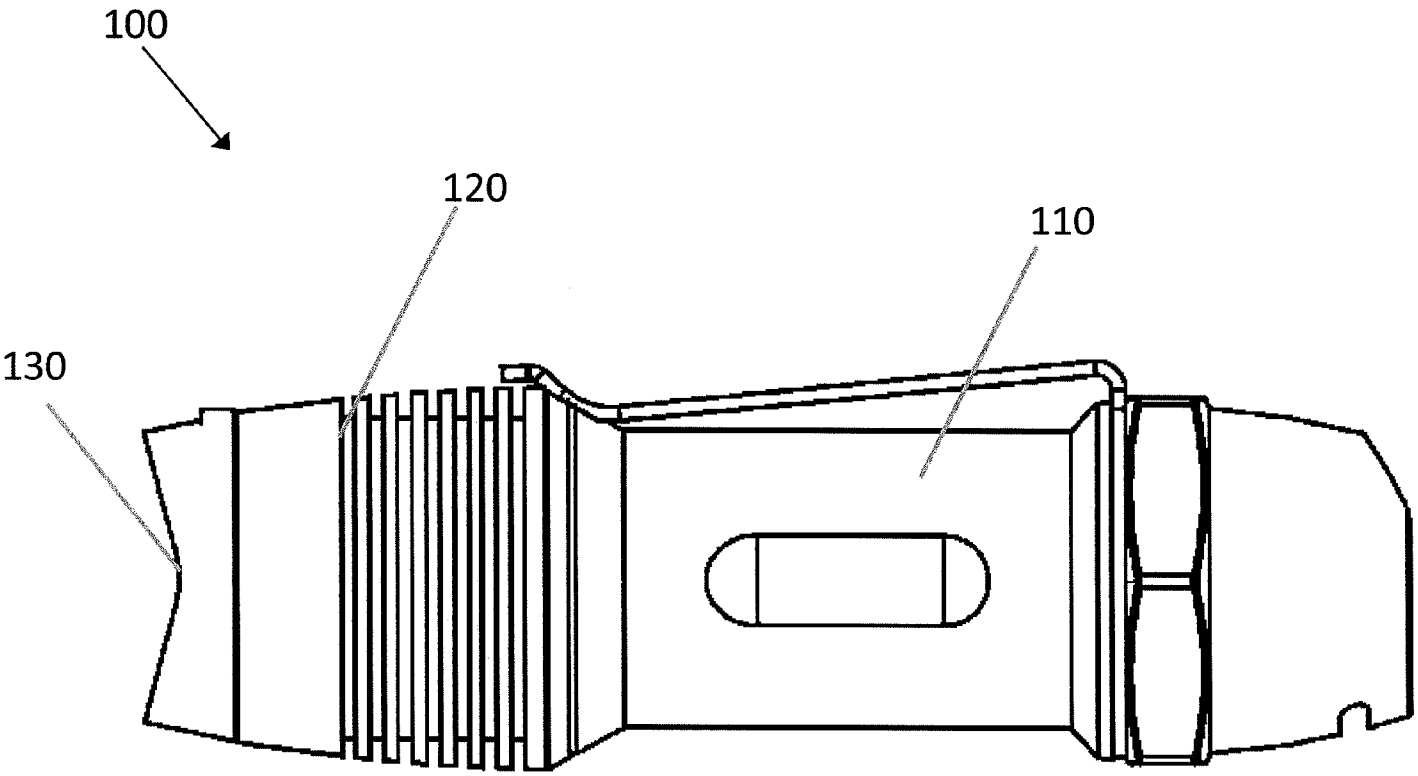
Figure 2:
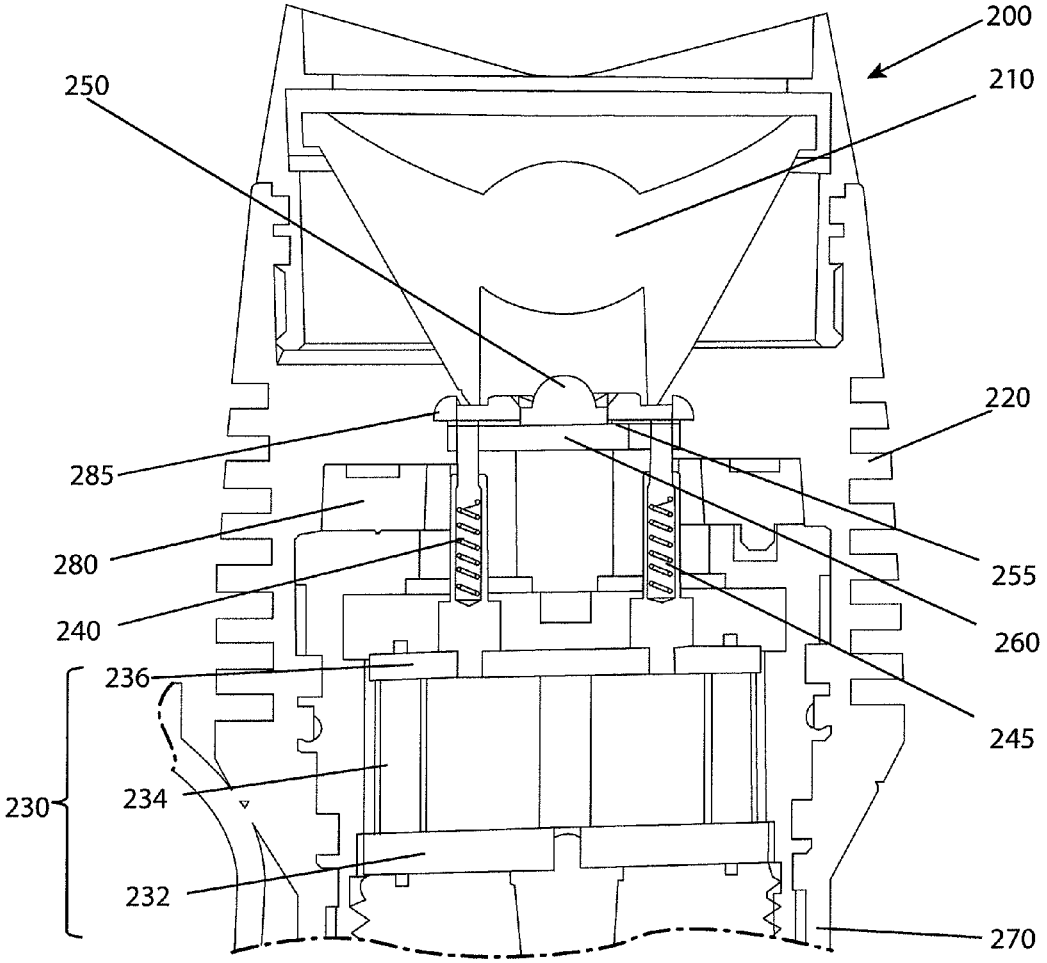
Figure 3:
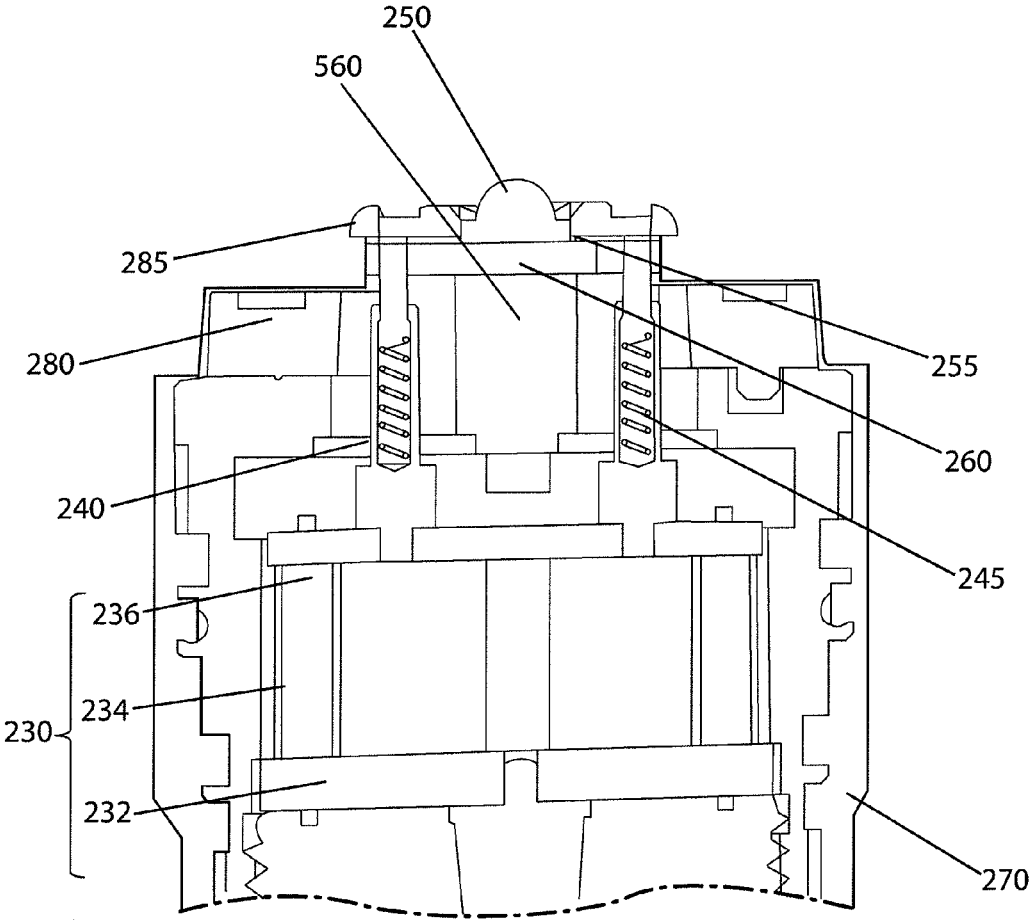
Figure 4:
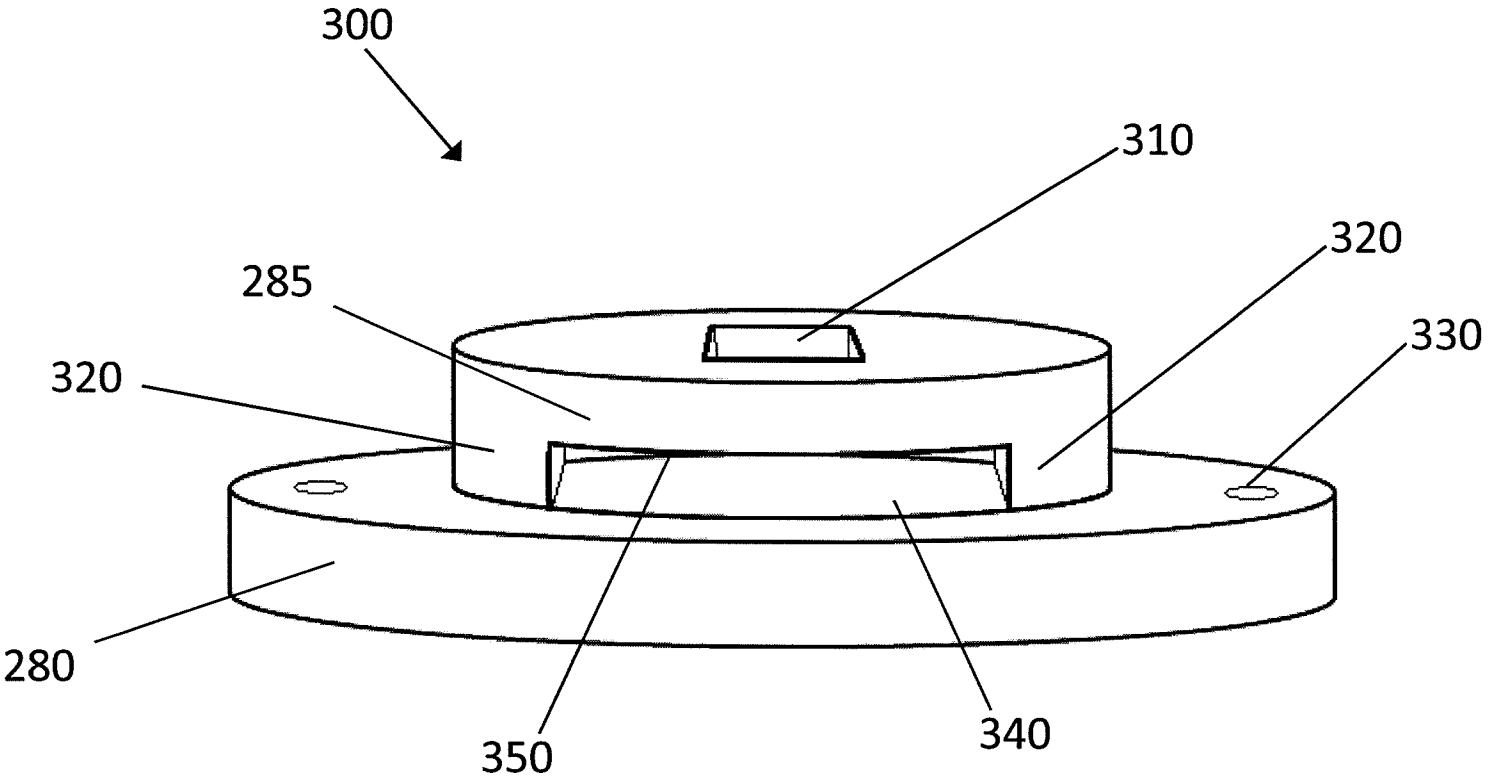
Figure 5:
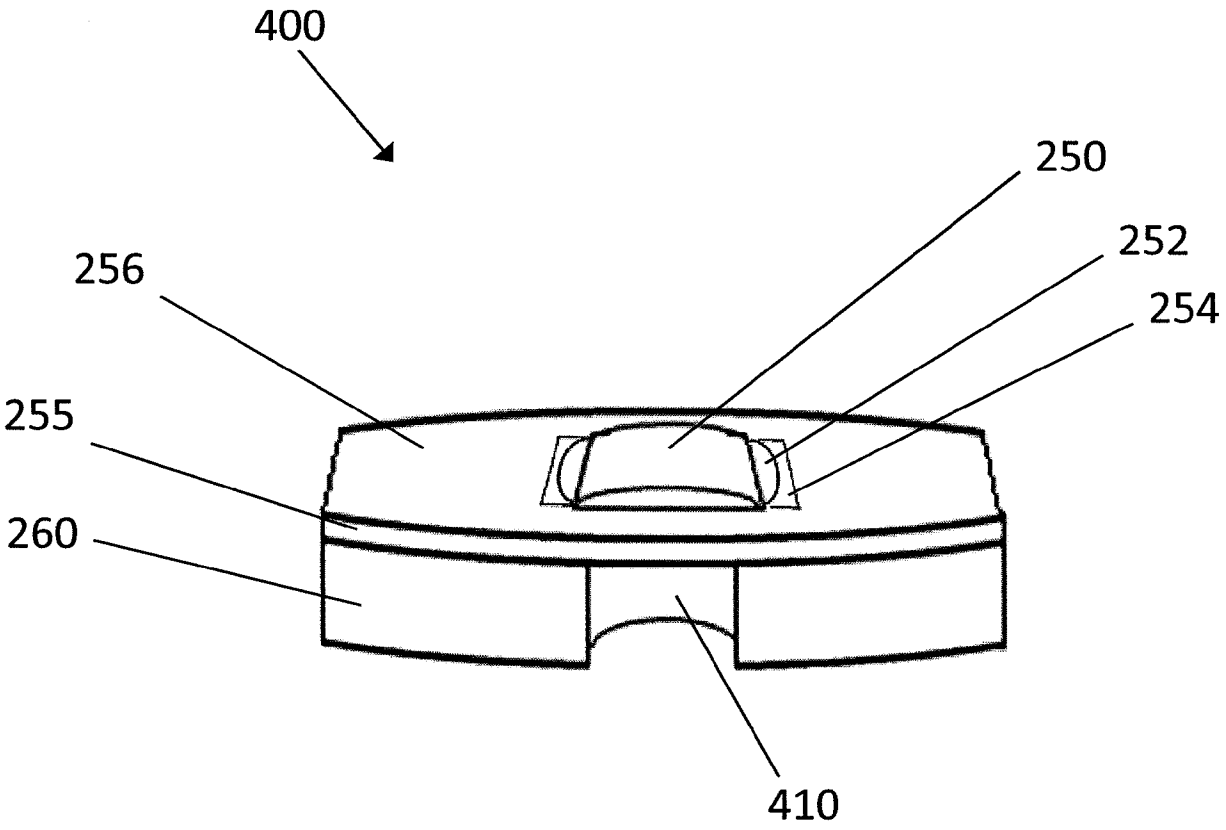
Figure 6:
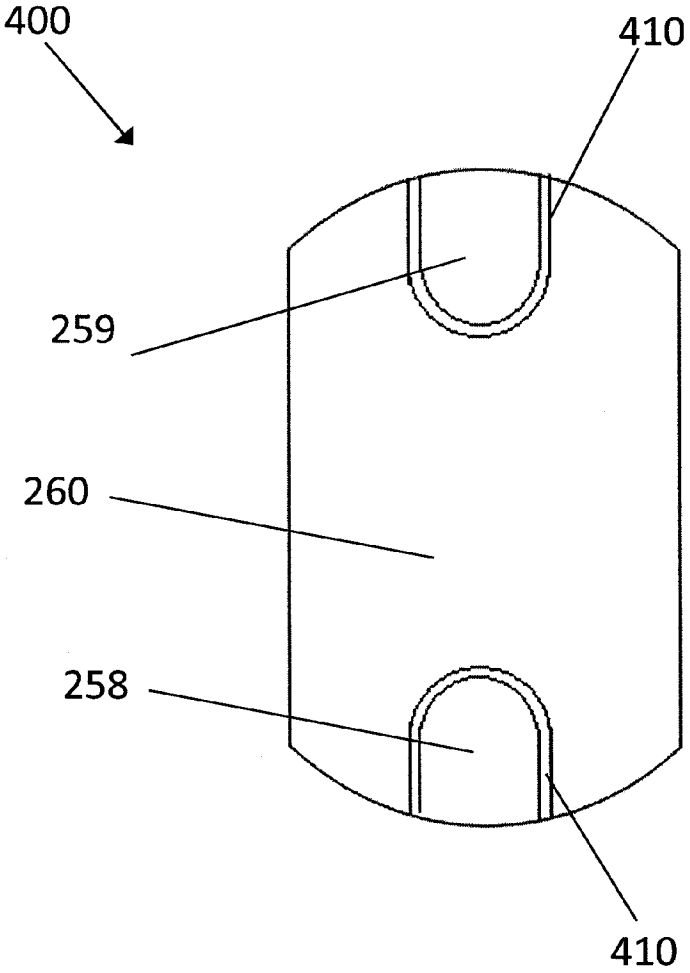
Figure 7:
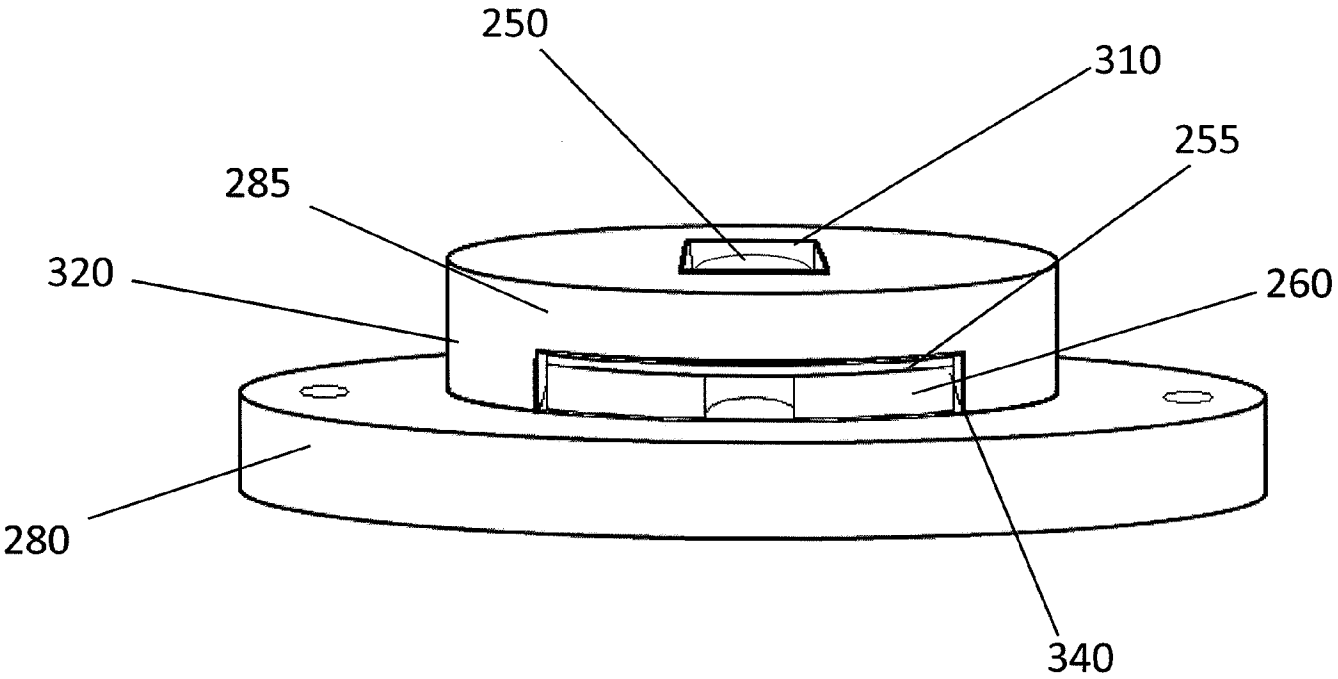
Figures 8A, 8B:
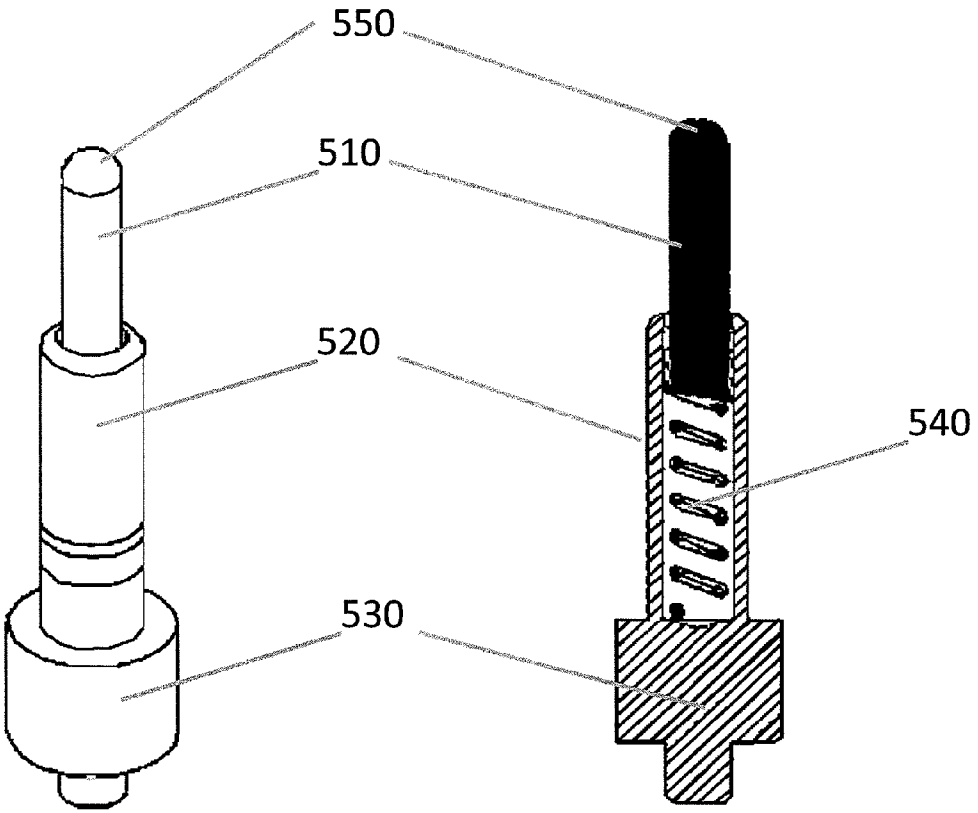
Figure 9:
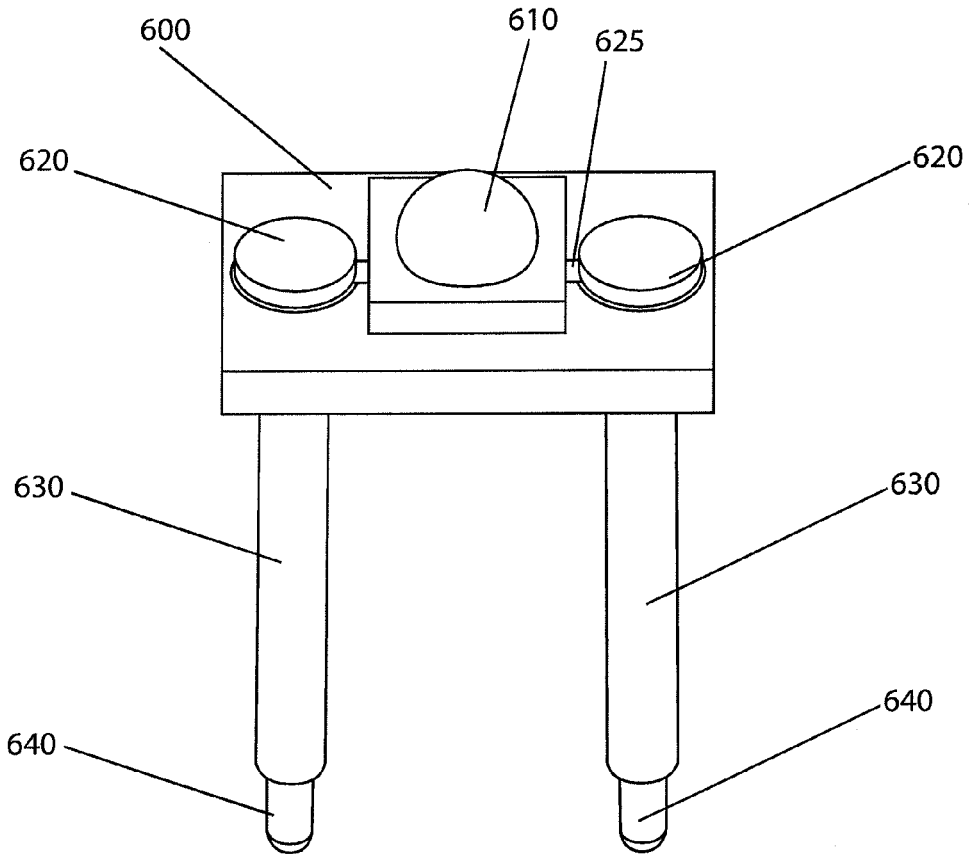
Figure 10:
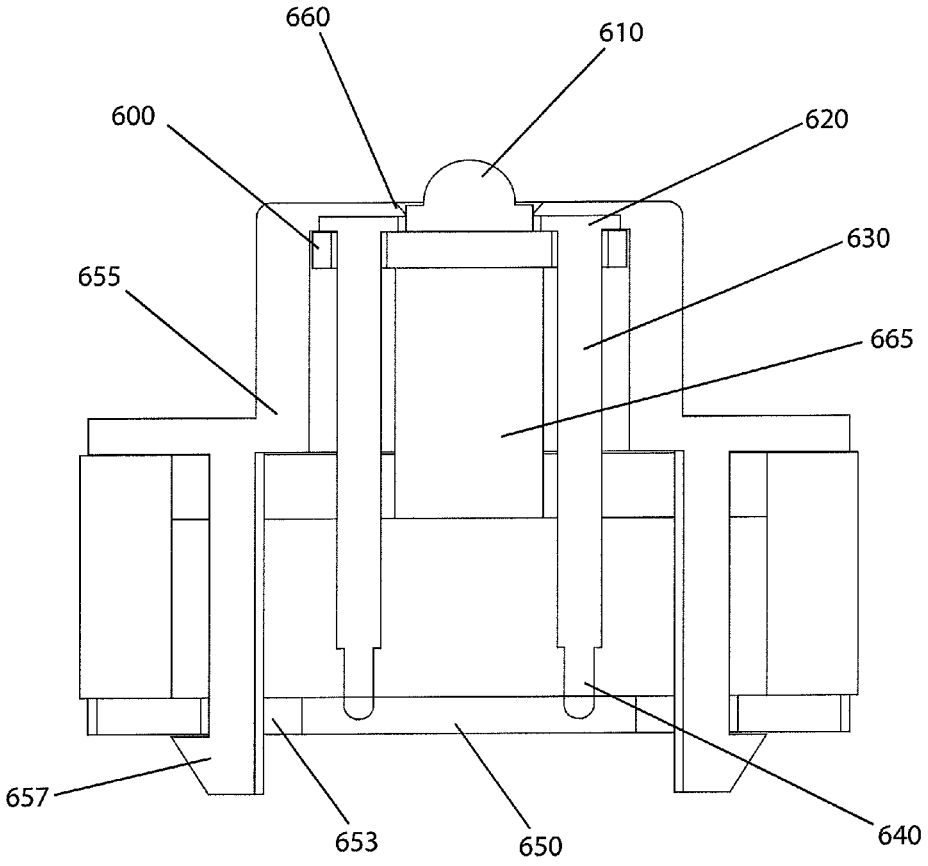
Figure 11:
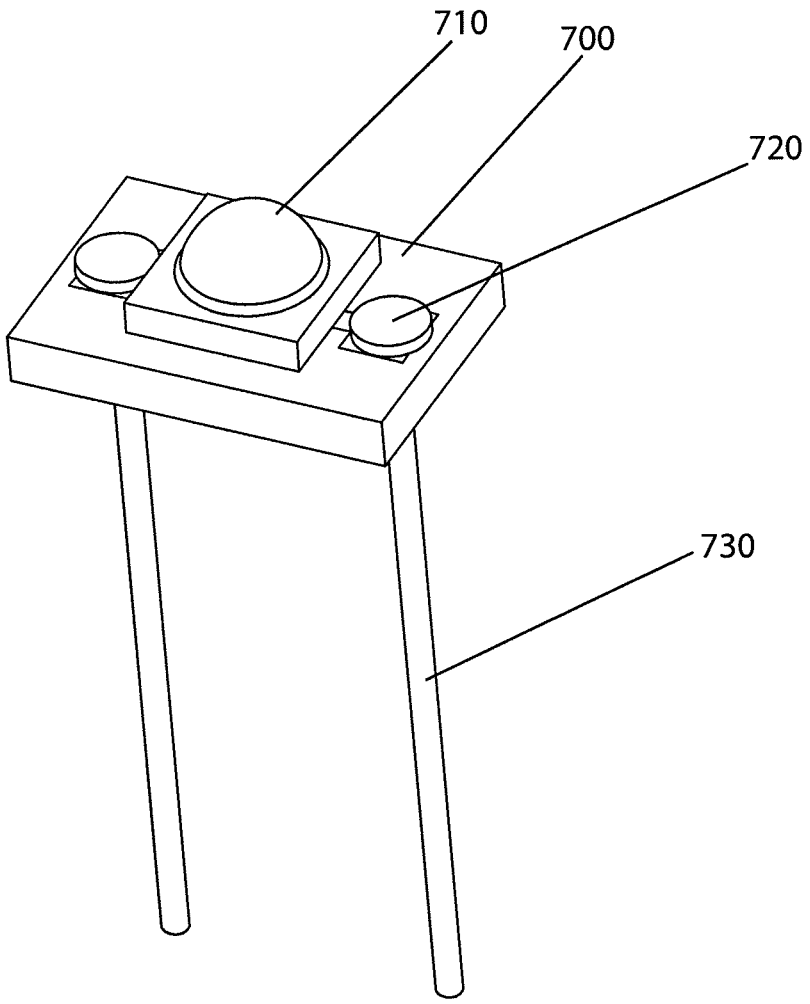
Figure 12:
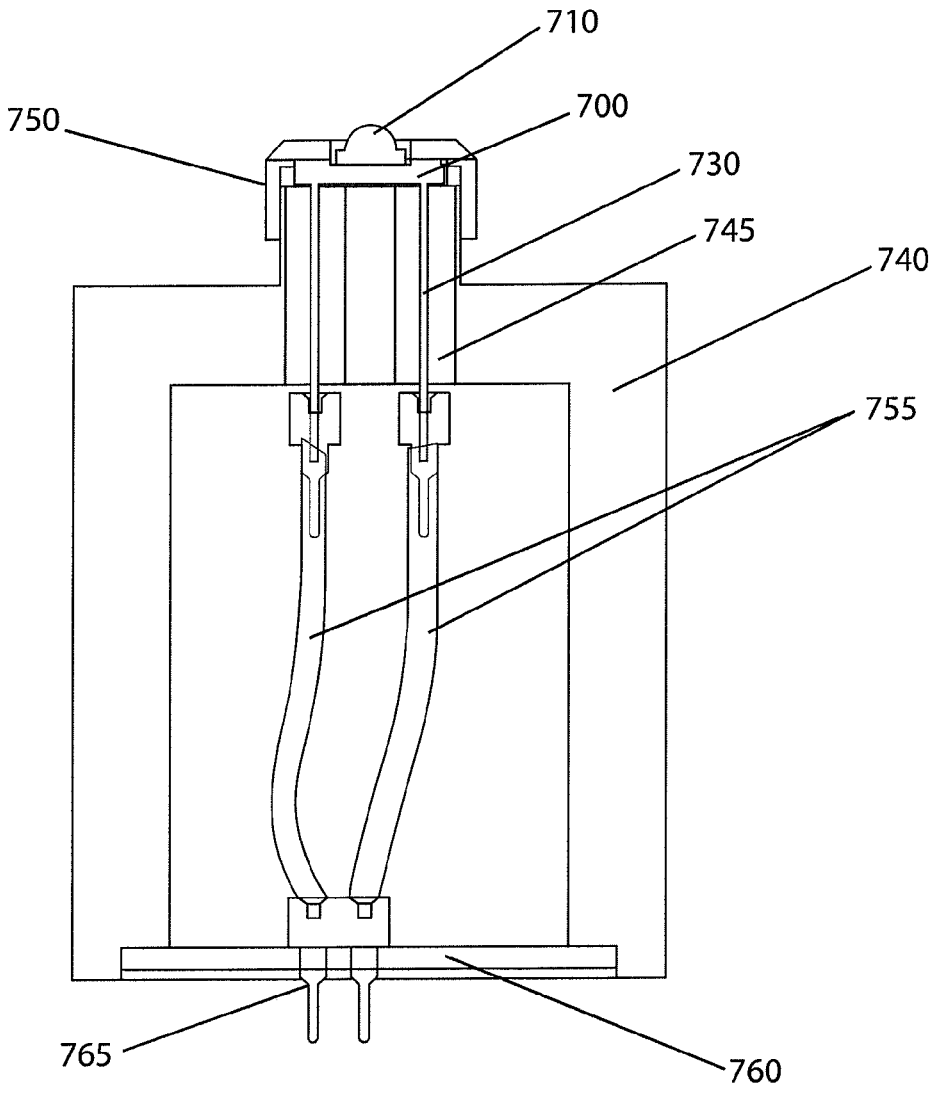
Figure 13:
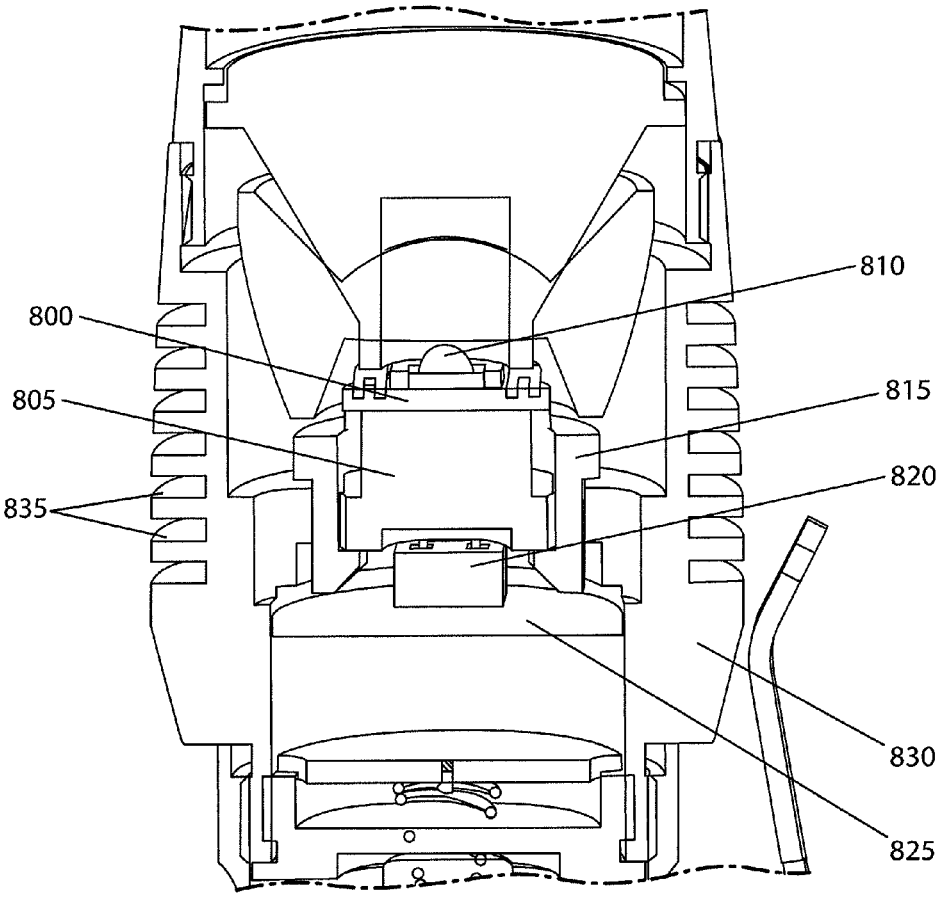
Figure 14:
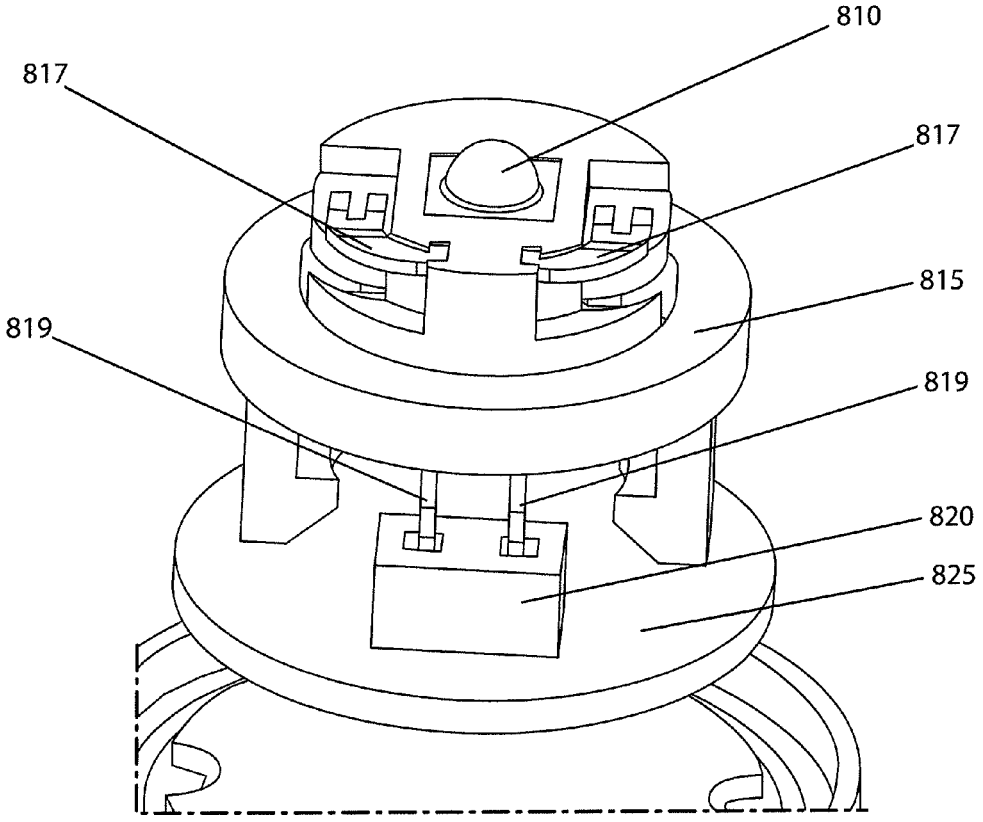
Figure 15:
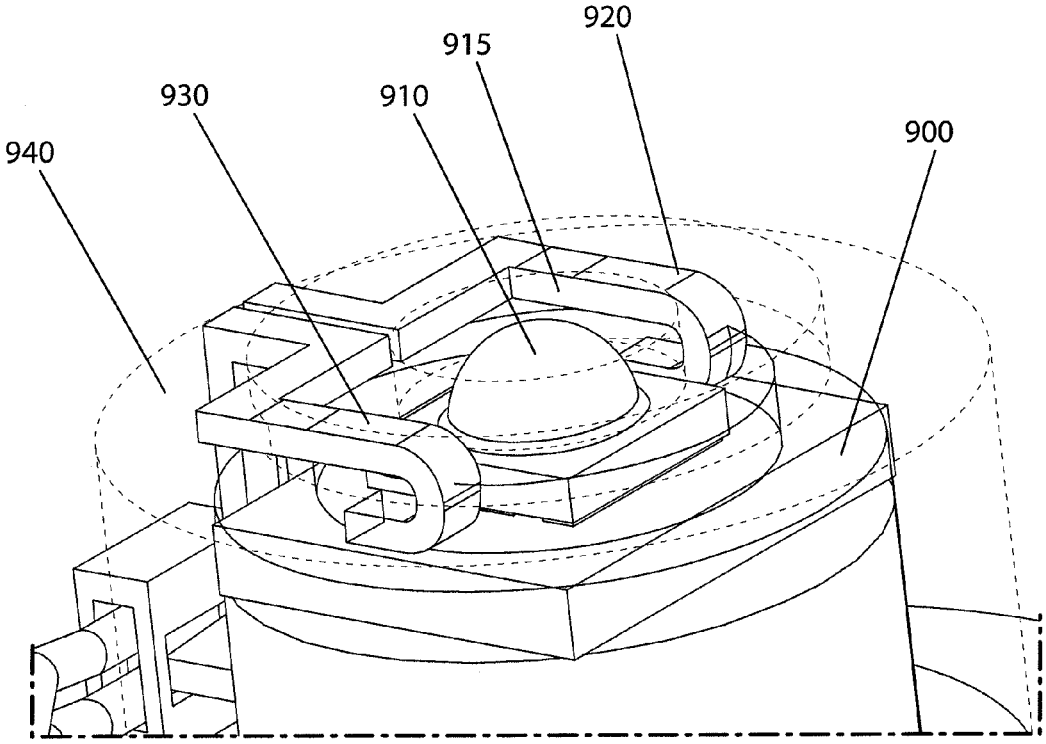
Figure 16:
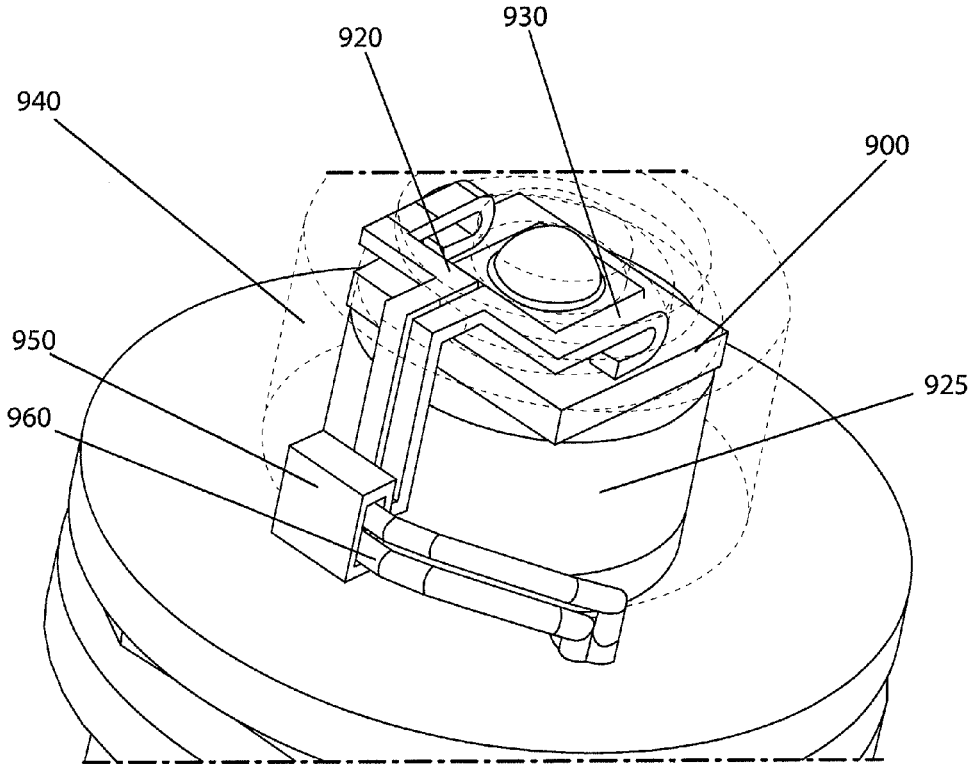
Figure 17:
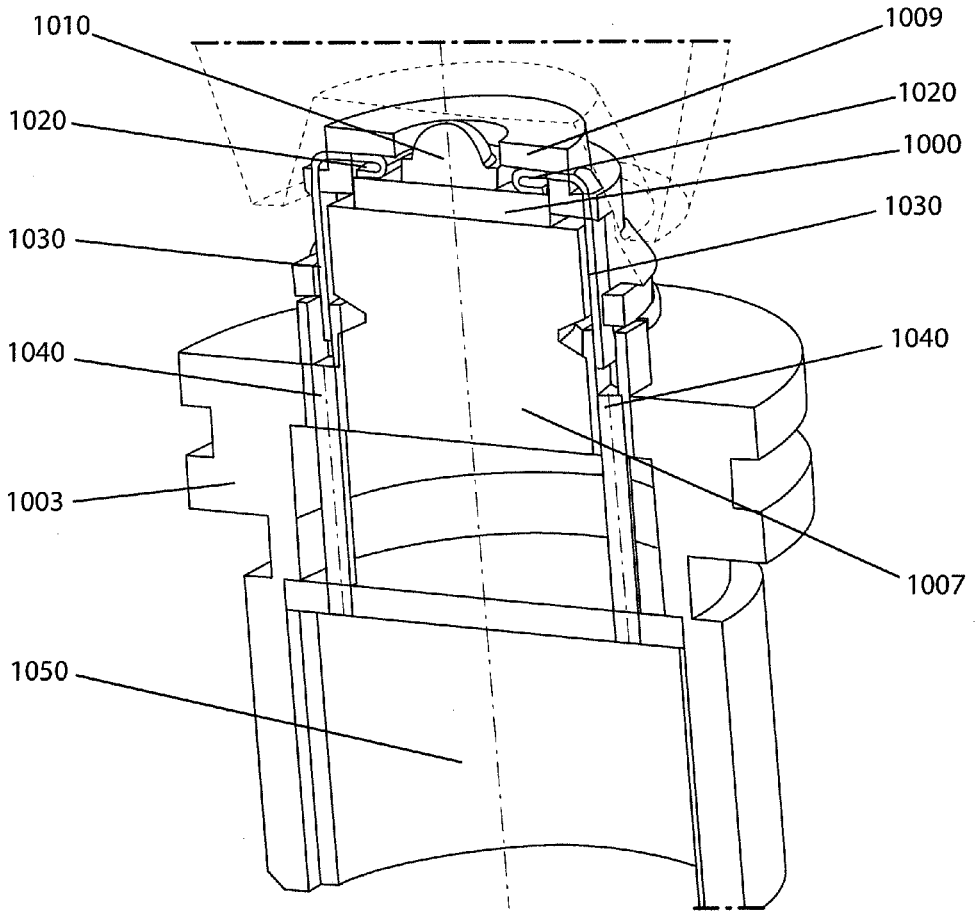
Figure 18:
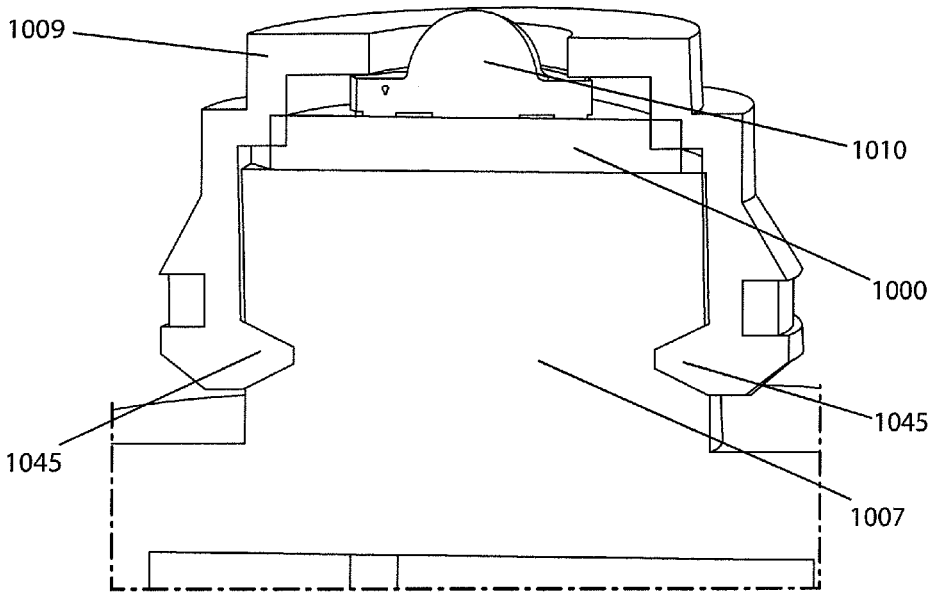
Figure 19:
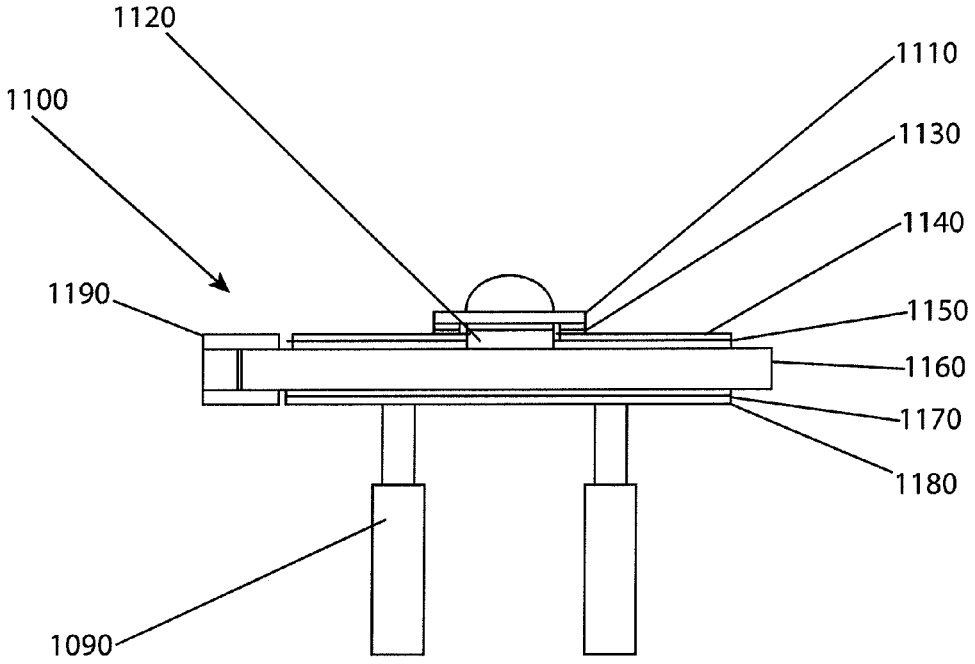

Having thus described the invention in general terms, reference will now be made to the accompanying drawings, which are not necessarily drawn to scale, and wherein:

FIG. 1 is an illustration of a flashlight which may implement embodiments of the present invention;

FIG. 2 is a cross-sectional view of a flashlight lens housing and barrel including the modular LED circuitry according to an example embodiment of the present invention;

FIG. 3 is a cross sectional view of the flashlight of FIG. 2 with the lens housing removed for ease of illustration;

FIG. 4 is a perspective view of an alignment apparatus for an LED according to an example embodiment of the present invention;

FIG. 5 is a perspective view of an LED circuit board according to an example embodiment of the present invention;

FIG. 6 is a bottom plan view of the LED circuit board according to an example embodiment of the present invention;

FIG. 7 is an assembly drawing of the LED circuit board of FIGS. 5 and 6 as received within the alignment apparatus of FIG. 4;

FIG. 8A is a perspective view of a pin of an LED driving circuit according to an example embodiment of the present invention;

FIG. 8B is a cross-section view of the pin of FIG. 8A;

FIG. 9 is a perspective view of an LED circuit board comprising pins according to an example embodiment of the invention;

FIG. 10 is a cross-section view of an LED circuit assembly implementing the LED circuit board of FIG. 9;

FIG. 11 is a perspective view of an LED circuit board comprising pins according to an example embodiment of the invention;

FIG. 12 is a cross-section view of an LED circuit assembly implementing the LED circuit board of FIG. 110;

FIG. 13 is a cross-section view of a flashlight implementing an example embodiment of the LED circuit assembly according to example embodiments of the present invention;

FIG. 14 is a perspective cut-away view of the LED circuit assembly as implemented in the embodiment of FIG. 13;

FIG. 15 is a perspective view of an LED circuit assembly including a housing configured to receive the LED therein according to an embodiment of the present invention;

FIG. 16 is another perspective view of the LED circuit assembly of claim 15;

FIG. 17 illustrates a cross-section view of another example embodiment of an LED circuit assembly according to the present invention;

FIG. 18 illustrates a cross-section view of the embodiment of FIG. 17 with a cap secured in place; and FIG. 19 is a schematic of an LED circuit board for implementation in various embodiments of the present invention.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Example embodiments of the present invention are generally described and depicted as embodied within a flashlight form factor; however, as will be apparent, embodiments of the present invention may be scalable and may be used in virtually any form factors, such as residential or commercial light fixtures, automotive applications (e.g., headlights, signal lights, and/or interior lighting), headlamps, interior/exterior lighting, street lighting, among others. As such, the disclosure is intended to merely provide example embodiments and not to be limiting.

Referring now to the example of FIG. 1, embodiments of the present invention may be implemented in flashlights, such as flashlight 100 of FIG. 1 which includes a body 110, a lens housing 120, and a lens 130. The lens housing 120 may further include a reflector (such as a substantially parabolic reflector) to amplify the intensity of the light by reflecting a portion of the light beam emanating from the light source which is not directed toward the lens. Optionally, the lens may be configured to refract the light in order to allow the light beam emanating from the light source to be focused to a desired focal length. The reflector and/or refractive lens may be adjustable in order to adjust the focal distance of the light beam from the flashlight 100.

While conventional incandescent bulbs may emit a light pattern which emanates from the bulb in a hemispherical pattern, requiring a reflector and/or refractive lens to focus the beam into a conical pattern, LED lights may provide a more focused, conical beam without the need for a reflector or refractive lens. Therefore, LED flashlights or other LED light sources may not require reflectors and/or refractors. However, in order to maximize the versatility of an LED light source, a refractive lens may be used to enhance and focus the light beam of an LED.

Relative to their size, LEDs can provide a large amount of light as compared to other types of light sources. Due to their compact size and construction, LEDs can also generate a great deal of heat relative to their size. Overheating of an LED may lead to premature failure. As such, example embodiments of the present invention may provide improved heat dissipation properties for an LED and an LED circuit assembly, while also providing a modular, scalable design which can be used in any size and shape form factor suitable for an LED light source.

FIG. 2 illustrates a cross-section of a flashlight form factor implementation example of the present invention including a lens housing 200 and barrel 270. The lens housing 200 of the illustrated embodiment includes a refractive lens 210 and heat-dissipating fins 220 disposed about the perimeter of the lens housing 200. The lens housing may be made of a material with good heat transfer properties in order to better dissipate heat from the LED. Materials such as aluminum have superior heat transfer properties than, for example, plastic, which does not conduct heat as well. The lens 210 may be made from poly-acrylic, glass, or any other material which preferably provides high transparency and refractive qualities. The lens housing 200 may be removable from the barrel 270 of the flashlight and the interface between the lens housing 200 and the barrel 270 may provide an adjustment to vary the distance between the LED 250 and the lens 210, thereby changing the focal distance of the flashlight beam.

FIG. 3 illustrates the flashlight of FIG. 2 with the lens housing 200 removed. FIGS. 2 and 3 depict an LED circuit assembly for supporting and driving an LED. While the LED circuit assembly is illustrated as being housed within or attached to the barrel 270, example embodiments may also be disposed within the lens housing 200. Further, the LED circuit assembly of other example embodiments may be disposed within, for example, a threaded base configured to be received by a conventional light socket for a residential or commercial light fixture.

The modular LED circuit assembly of the illustrated embodiment includes an LED driving circuit 230 comprising a first LED driving circuit board 232, a second LED driving circuit board 236, and spacers 234 disposed therebetween. The illustrated LED driving circuit is shown as two separate circuit boards 232, 236, electrically connected through pins disposed within the spacers 234; however, this arrangement may be designed for a small form-factor package. The two circuit boards 232, 236 may be embodied as a single board in other example embodiments. One advantage of the illustrated configuration is that components of the LED driving circuit 230, such as microchips, resistors, capacitors, etc., disposed on the circuit boards 232, 236, may be disposed between the two circuit boards in an arrangement that permits heat dissipation and isolation from other elements of the flashlight. Extending from the LED driving circuit of the illustrated embodiment are two pins 240, 245 which provide the anode and the cathode for driving the LED.

The embodiment of FIG. 3 further depicts an alignment apparatus for an LED comprising a first element 285 and a second element 280. FIG. 4 depicts a perspective view of the alignment apparatus 300. It is noted that the alignment apparatus 300 of FIGS. 4 and 7, and the circuit boards of FIGS. 5 and 6, are rotated 90 degrees relative to the illustration of FIGS. 2 and 3. The alignment apparatus 300 includes an aperture 310 in the first element 285 for receiving the LED (250 of FIG. 3). The aperture 310 may be sized and shaped according to the size and shape of the LED that is to be received therein such that the aperture 310 may align the LED for proper projection of the beam of light emanating from the LED. The first element 285 may be attached to the second element 280 by attachment portions 320. While the illustrated embodiment depicts two attachment portions 320, there may be only one attachment portion 320 or many attachment portions 320 disposed about the first element connecting the first element 285 to the second element 280. However, as will be appreciated in light of the description below, it may be desirable to have a substantial portion of the area between the first element 285 and the second element 280 void of an attachment portion for heat dissipation purposes. In the illustrated embodiment, the first element 285, the second element 280, and the attachment portions 320 combine to define an air gap 340 between them. The first element 285, second element 280, and the attachment portions 320 may be made of a single, unitary piece, such as a molded unit.

The alignment apparatus may be configured with attachment holes 330 or similar features in order to secure the alignment apparatus to the flashlight barrel 270. As will be described further below, the alignment apparatus may be used to secure the LED circuit within the housing, such as the barrel 270 of a flashlight.

As described above, the alignment apparatus 300 include an aperture 310 in the first element 285 to receive LED 250. FIG. 5 illustrates such an LED 250 as attached to an LED circuit board 255. The circuit board may include a first major surface 256 upon which are first and second contact pads 254. The LED 250 includes two connectors 252 which may each be secured to a respective contact pad 254 of the LED circuit board 255. The connectors may be soldered or otherwise secured to a respective contact pad via an electrically conductive adhesive. The LED circuit board 255 of the illustrated embodiment includes a second major surface which is disposed on the side of the circuit board 255 opposite the first major side 256. A substrate 260 may be attached to a portion of the second major surface. The substrate 260 may be made of a thermally conductive material, such as copper or aluminum, among others, and may be secured to an area of the second major surface of the circuit board 255. The substrate 260 may be attached to the circuit board 255 by a thermally conductive adhesive such that heat generated by the LED may be dissipated through the attached substrate 260.

Further illustrated in FIG. 5 is a cut-out in the substrate 260 such that a portion of the second major surface of the circuit board 255 is exposed and accessible. A similar cut-out is disposed on the opposite side of the substrate 260 as shown in FIG. 6. The two portions of the second major surface of the circuit board 255 which are exposed and accessible may include a first area of the second major surface of the circuit board 255 and a second area of the second major surface of the circuit board. Each of the first area and the second area may be electrically conductive areas that are configured to receive the pins (240 and 245 of FIGS. 2 and 3). The first and second pins may each make electrical contact with a respective one of the first area and second area of the second major surface of the circuit board 255. Each of the first area and the second area may further be in electrical contact with a respective contact pad 254 of the first major surface of the circuit board 255. Thus, each of pins 240, 245 of the LED driving circuit are in electrical contact with a respective connector 252 of the LED 250 upon the pins 240, 245 engaging the first area and second area of the second major surface of the circuit board 255.

FIG. 6 illustrates a plan view of the circuit board as viewed from the second major surface. As shown, the cut-outs 410 in the substrate 260 expose the first area 258 and second area 259 of the second major surface of the circuit board which are each configured to be contacted by a respective pin of the LED driving circuit. The substrate 260 is attached to a third area of the second major surface of the circuit board in order to dissipate heat from the LED 250 and the circuit board 255.

As illustrated in FIG. 7, which depicts the circuit board 400 engaged with the alignment apparatus 300, the first major surface 256 of the circuit board 255 is received on a first side of the first element 285 such that the LED 250 is received within aperture 310 of the first element 285. The circuit board 255 and substrate 260 are disposed between the first element 285 and the second element 280, with a portion of the substrate 260 visible through the air gap 340 of the alignment apparatus 300. The exposure of the substrate 260 through the air gap 340 provides improved heat dissipation from the substrate 260, allowing heat to escape to an area above the alignment apparatus rather than trapping the heat behind the alignment apparatus within the barrel 270 of the flashlight.

Referring back to FIG. 3, when assembled, the LED circuit assembly includes LED driving circuit 230 which receives power from a power source (e.g., a battery) and provides power to the LED circuit board 255 through pins 240, 245. FIG. 8A illustrates a perspective view of a pin according to example embodiments while FIG. 8B illustrates a cross-section thereof. Each of the pins includes a barrel 520, a base 530, and a shaft 510. The shaft 510 is received within the barrel and the shaft is spring biased in an extended position by biasing element 540, which in the instant embodiment is a coil spring. The shaft 510 may travel within the barrel 520 between a fully retracted position and a fully extended position. This range of motion allows alignment between the LED driving circuit and the LED circuit board to vary within the range of travel of the shaft 510 within the barrel 520. Due to manufacturing variations in the alignment apparatus, when the alignment apparatus, including the LED circuit board and LED, is assembled onto the barrel 270 in the illustrated embodiment, the spring-biased pins 240, 245 can absorb some degree of manufacturing variation.

As further illustrated in FIGS. 8A and 8B, the top of the shaft 510 of each pin (e.g., pins 240, 245) includes a contact surface with a contact area. The contact surface of a pin is configured to contact one of the first area or the second area of the second major surface of the LED circuit board across the contact area. This establishes electrical continuity between the pin and the first area or the second area. As illustrated in FIG. 6, the first area 258 and the second area 259 each have an area that is larger than that of the contact area of the contact surface 550 of the pin. Further, the cut-outs 410 are of a size exceeding that of the diameter of the shaft 510. Thus, the contact surface of the pins may establish electrical contact with the first area 258 and the second area 259 anywhere across their areas. This permits an error tolerance of alignment of the pins relative to the circuit board 255. Since the pins can move within the cut-outs 410, and contact between the pins and the first area 258 or second area 259, the alignment can vary to a certain degree along the plane of the circuit board 255 (i.e., in two orthogonal degrees of freedom).

Between the alignment error tolerance provided by the configuration of the circuit board 255, substrate 260, and the cut-outs 410, and the spring-biased travel of the shaft 510 of the pins 240, 245 within the barrel 520, there is an alignment error tolerance between the LED driving circuit 230 and the LED circuit board 255 in all three mutually orthogonal axes of movement, allowing for greater variances in manufacturing tolerances. By increasing the tolerances, manufacturing costs can be reduced.

While the pins 240, 245 have been shown to contribute to the flexibility in manufacturing tolerances, the pins also afford the LED circuit board additional space that improves the heat dissipation properties of the modular LED circuit assembly. Referring again to FIG. 3, the pins 240, 245 extending from the LED driving circuit 230 allow separation between the LED driving circuit and the circuit board 255. This provides an air-gap 560 between the LED driving circuit 230 and the circuit board 255, allowing the substrate 260 to better dissipate heat. This additional space better resists heat buildup within the modular LED circuit assembly, extending the life of the LED and the circuitry components.

For purposes of the above specification and foregoing claims, the term light emitting diode or "LED" may include without limitation high brightness white LEDs, blue LEDs, red LEDs, orange LEDs, amber LEDs, yellow LEDs, green LEDs, bi- or tri-color LEDs, multi-colored LEDs, infrared LEDs, and ultraviolet LEDs. Such LEDs advantageously provide a relatively high level of illumination with relatively minimal power requirements as compared to traditional incandescent or resistor-based light bulbs.

While FIGS. 2-7 illustrate a first embodiment of a system for a modular light-emitting diode circuit assembly, further example embodiments are described herein which may further provide for alignment and improved heat dissipation in a light-emitting diode assembly. FIG. 9 illustrates an example embodiment which implements pins, similar to those of FIGS. 8A and 8B. In the illustrated embodiment of FIG. 9, the pins, including barrels 630 and the spring biased shafts 640 received therein, are attached to the LED circuit board 600 at pads 620. The pads 620 are each in electrical contact with a respective connector of the LED 610 by a trace 625 on the LED circuit board 600.

FIG. 10 illustrates a cross-section view of an assembly for an LED implementing the LED circuit board 600 and pin configuration illustrated in FIG. 9. The LED circuit board 600 is supported within a housing 655 configured with an aperture 660 through which LED 610 is received. The pins, including barrels 630 and shafts 640 are disposed in electrical contact with the LED driving circuit board 650. In some embodiments, the LED driving circuit board may be secured within the barrel of a flashlight, such as barrel 270 of FIG. 2, and may include apertures 653 arranged to receive locking tabs 657 of the housing 655. In this manner, the housing 655 may receive the LED circuit board 600 including the LED 610 and the pins. The housing 655 may then be secured to the LED driving circuit board 650 by locking tabs 657. The travel of the shafts 640 within the barrels 630 of the pins allows for a degree of variation in manufacturing tolerances of the housing 655 and the location of the LED driving circuit board 650 within the barrel of the flashlight.

As described with respect to the embodiment of FIGS. 2-7, the spacing between the LED circuit board 600 and the LED driving circuit board 650 may allow for improved heat dissipation from the LED circuit board. While the area between the LED circuit board 600 and the LED driving circuit board 650 may remain open to allow air to flow therebetween, a heat conducting material may be attached to the LED circuit board, such as material 665 illustrated in FIG. 10. This material may aid in the dissipation of heat from the LED circuit board 600.

FIG. 11 illustrates an LED circuit board of another example embodiment of the present invention in which the LED circuit board 700 includes an LED 710 and pins 730 attached to the LED circuit board 700 at pads 720. The pins 730 of the embodiment of FIG. 11 may be of fixed length as will be apparent to one of ordinary skill in the art. FIG. 12 illustrates an example embodiment of an assembly for an LED circuit implementing the LED circuit board of FIG. 11. The LED circuit board 700 is received on a housing 740 with pins 730 received within openings 745. The LED circuit board 700 may be secured to the housing 740 by a cap 750 with an aperture there through to receive the LED 710. Each of the pins 730 may be configured to be attached to wires 755 extending between the pins 730 and the LED driving circuit board 760. The pins may be secured to the LED driving circuit board by any conventional means.

FIG. 13 illustrates another example embodiment of an assembly for an LED. The illustrated embodiment includes a cross-section of a lens housing 830, similar to that illustrated in FIG. 2, including heat dissipating fins 835. The LED driving circuit board 825 may be received within the lens housing 830 as illustrated; however, further embodiments may include the LED driving circuit board disposed in the barrel of the flashlight. The LED driving circuit board 825 may include a pin socket 820 configured to receive the pins attached to the LED circuit board 800. The LED circuit board may be received within a housing 815. The housing, as illustrated in FIG. 14, may include an aperture for receiving the LED 810 and may include two conductive traces 817 adapted to electrically engage a respective connector of the LED 810. Each of the conductive traces 817 may include a pin 819 that extends through the housing 815 and is configured to be received within socket 820 of the LED driving circuit board 825. As illustrated in FIG. 13, the housing may further include a heat sink 805 with high thermal conductivity arranged to at least partially fill the void between the LED circuit board 800 and the LED driving circuit board 825 that is created by example embodiments of the present invention. The illustrated heat sink 805 may be omitted in embodiments in which an air gap between the LED circuit board 800 and the LED driving circuit board 825 is deemed sufficient to dissipate sufficient heat from the LED circuit board 800.

FIG. 15 illustrates another example embodiment of an assembly for an LED. In the illustrated embodiment, a housing 940 includes electrically conductive prongs 920 and 930. The prongs 920, 930 maybe molded into the housing 940. The housing 940 is configured to receive an LED circuit board 900 into a cavity within the housing 940. An LED 910 disposed on the LED circuit board 900 is received within aperture 915 of the housing 940. The conductive prongs 920, 930 are each configured to make electrical contact with a respective connector of the LED 910.

Referring now to FIG. 16, each of the conductive prongs 920 and 930 extend through the housing to terminal 950 where they connect with wires 960. The wires 960 may subsequently engage the LED driving circuit board. An inner area 925 of housing 940 may be configured to help dissipate heat from the LED circuit board 900. The inner area 925 may be an air gap through which air can conduct heat away from the LED circuit board 900, or alternatively, the inner area 925 may include a material with a high thermal conductivity to function as a heat sink.

FIG. 17 illustrates another example embodiment of the invention depicting a cross-section of an assembly for supporting an LED circuit. As illustrated, an LED circuit board 1000 including LED 1010 is received on top of a projection 1007 extending from housing 1003. The projection 1007, and possibly the housing 1003, may be made from a material with a high thermal conductivity in order to dissipate heat efficiently from the LED circuit board 1000. Extending from the housing may be two housing connectors 1040 which are configured to conduct electric current between the LED circuit board 1000 and the LED driving circuit board (not shown). The LED driving circuit board may be located within housing 1003, for example. A cap 1009 may be received on top of the LED circuit board 1000 and affixed to the projection 1007. Within the cap 1009 may be first and second electrically conductive prongs 1020. Each conductive prong 1020 may be configured to engage a respective connector of the LED 1010. The conductive prongs 1020 include traces 1030 which extend down along the projection 1007 and electrically connect the prongs 1020 to the housing connectors 1040.

FIG. 18 illustrates a cross-section of the projection 1007 and cap 1009 received thereon, while not illustrating the prongs 1020. As shown, the cap 1009 is received on the projection 1007 and engages the projection by means of teeth 1045, thereby securing the cap 1009 to the projection 1007 and securing the LED circuit board 1000 therebetween.

FIG. 19 illustrates a diagram of an example embodiment of an LED circuit board according to the present invention. The embodiment of FIG. 19 may be used in some or all of the example embodiments of assemblies outlined above. The illustrated embodiment includes an LED 1110 that is electrically connected to the LED circuit board 1100 at solder points 1130, with one solder point for each of the two LED connections. Each of the solder points 1130 are connected to a layout 1140 arranged to route the conductive trace for each of the LED connections. An insulating material 1150 with a thermal conductivity of approximately 2.5 W/(m*K) may be disposed between the layout 1140 and a core 1160 made of a thermally conductive material such as copper. A heat sink 1120 of a high thermal conductivity material may be disposed between the LED 1110 and the core 1160, without being separated by the insulating layer 1150. The heat sink 1120 promotes heat dissipation directly from the LED 1110 to the core 1160 at a rate about 20 times greater than if the LED was separated from the core 1160 by the insulating layer 1150. Disposed on the other side of the core is a second insulating material layer 1170 with another layout 1180 disposed on the bottom side of the LED circuit board 1100. The layout 1180 may provide a conductive trace between the bottom side of the LED circuit board 1100 and the layout 1140 of the top side of the LED circuit board. Pins 1090 may be arranged to electrically engage a respective conductive trace to conduct electric current between a respective soldering pad 1130 and a respective pin 1090. A mechanical structure 1190 may be configured to engage the core 1160 to further dissipate heat from the LED circuit board 1100 and/or to support the LED circuit board within an LED supporting assembly.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An apparatus for supporting a light-emitting diode (LED), comprising:

an alignment member comprising a first element and a second element, wherein an alignment aperture is defined through the first element, wherein the first element surrounds the alignment aperture and is connected to the second element by at least one attachment portion, and wherein an air gap is defined between the first element and the second element;

an LED circuit board comprising a first major surface and a second major surface opposing the first major surface, the first major surface comprising a first contact pad and a second contact pad, each of the first contact pad and the second contact pad configured to receive a respective connector from the light-emitting diode, the second major surface comprising a first planar area, a second planar area, and a third area, wherein the circuit board is disposed between the first element and the second element; and a substrate attached to the LED circuit board across the third area of the second major surface;

wherein the LED circuit board is attached to the first element with the LED aligned with the alignment aperture and configured to emit light there through, and wherein at least a portion of the LED circuit board and the substrate are aligned with the air gap;

wherein the first planar area of the second major surface of the LED circuit board is configured to engage, at a portion of the planar area, a first pin of a light emitting diode driving circuit and the second planar area of the second major surface of the LED circuit board is configured to engage, at a portion of the planar area, a second pin of the light emitting diode driving circuit.

2. The apparatus according to claim 1, wherein the substrate comprises a material with a thermal conductivity greater than about 30 watts per meter-degree Kelvin (30 W/(m*k)).

3. The apparatus according to claim 2, wherein the substrate is adhered to the LED circuit board with an adhesive comprising a thermal conductivity greater than about 30 watts per meter-degree Kelvin (30 W/(m*k)).

4. The apparatus according to claim 1, wherein the first contact pad is in electrical contact with the first area of the second major surface, wherein the second contact pad is in electrical contact with the second area of the second major surface, and wherein the first contact pad and the second contact pad are not in electrical contact with one another.

5. The apparatus according to claim 1, wherein the first pin of the light emitting diode driving circuit has a first contact surface with a first contact surface area, wherein the first contact surface engages the first area of the circuit board across the first contact surface area, wherein the second pin of the light emitting diode driving circuit has a second contact surface with a second contact surface area, and wherein the second contact surface engages the second area of the circuit board across the second contact surface area.

6. The apparatus according to claim 5, wherein the first area of the LED circuit board is greater than the first contact surface area and wherein the second area of the LED circuit board is greater than the second contact surface area.

7. The apparatus according to claim 1, wherein an air channel is defined between the substrate and the light-emitting diode driving circuit.

8. An apparatus for aligning a light-emitting diode (LED) comprising:

a first element comprising a first side and second side, wherein the second side of the first element is configured to receive a LED circuit board with a light-emitting diode thereon;

wherein the first element defines an alignment aperture there through, wherein the aperture is configured to receive the light emitting diode;

a second element comprising a first side and a second side, wherein the first element is attached to the second element by a first attachment portion and a second attachment portion;

wherein an air gap is defined between the first element and the second element, and adjacent to the first and second attachment portions;

an LED circuit board comprising a first major surface, a second major surface, and a perimeter; and a substrate comprising a first major surface, a second major surface, and a perimeter, wherein the first major surface of the LED circuit board is attached to the second side of the first element, wherein the first major surface of the substrate is attached to the second major surface of the LED circuit board, and at least a portion of the LED circuit board perimeter and the substrate perimeter are aligned with the air gap, and wherein the LED circuit board is bounded by the first element, the second element, the first attachment portion, and the second attachment portion.

9. The apparatus of claim 8, wherein the second element defines an aperture there through configured to receive the LED circuit board.

10. The apparatus of claim 8, wherein the aperture of the first element is configured to align the LED circuit board with the light-emitting diode thereon.

11. The apparatus of claim 8, wherein the aperture is sized and shaped according to the light-emitting diode to be received there through.

12. The apparatus of claim 8, wherein the first element, the second element, and the first attachment portion are formed of a single, unitary piece of material.

13. The apparatus of claim 8, wherein the first element comprises a material that is substantially electrically non-conductive.

14. An apparatus for supporting a light-emitting diode (LED), comprising:

an LED circuit board comprising a first major surface, an opposing second major surface, and a perimeter, the first major surface comprising a first contact pad and a second contact pad, each of the first contact pad and the second contact pad configured to receive a respective connector from the light-emitting diode, the second major surface comprising a first planar area, a second planar area, and a third area;

an alignment member comprising a first element and a second element, wherein the first element is attached to the second element by an attachment portion, and an air gap is defined between the first element and the second element, wherein the first element defines and surrounds an alignment aperture, wherein the alignment member is configured to receive the LED circuit board and the alignment aperture is configured to receive and align the light-emitting diode, and at least a portion of the perimeter of the LED circuit board is aligned with the air gap; and a light-emitting diode driving circuit comprising a first pin and a second pin, wherein the first pin is configured to electrically contact the first planar area of the second major surface and the second pin is configured to electrically contact the second planar area of the second major surface.

15. The apparatus according to claim 14, wherein the first pin and the second pin of the light-emitting diode driving circuit each comprise a barrel and a shaft, wherein the shaft is biased in an extended position within the barrel.

16. The apparatus according to claim 15, wherein the first pin comprises a first contact surface having a first contact surface area and the second pin comprises a second contact surface having a second contact surface area, wherein electrical contact between the first pin and the first area is established across the first contact surface area, and wherein electrical contact between the second pin and the second area is established across the second contact surface area, and wherein the size of the first area is greater than the size of the first contact surface area and the size of the second area is greater than the size of the second contact surface area.

17. The apparatus according to claim 16, wherein the first pin and the second pin cooperate with the first area and the second area of the second major surface, respectively, to maintain electrical contact between the first area and the first pin and the second area and the second pin during relative motion between the LED circuit board and the light emitting diode driving circuit in any of three mutually orthogonal axes of movement.

* * * * *